US008424502B2

(12) United States Patent
Takakuwa et al.

(10) Patent No.: US 8,424,502 B2
(45) Date of Patent: Apr. 23, 2013

(54) INTAKE MANIFOLD

(75) Inventors: Minoru Takakuwa, Handa (JP); Hideki Inaba, Gifu (JP); Keita Izumi, Tokyo (JP)

(73) Assignees: Toyota Boshoku Kabushiki Kaisha, Aichi-Ken (JP); Fuji Jukogyo Kabushiki Kaisha, Tokyo (JP)

( * ) Notice: Subject to any disclaimer, the term of this patent is extended or adjusted under 35 U.S.C. 154(b) by 443 days.

(21) Appl. No.: 12/749,574

(22) Filed: Mar. 30, 2010

(65) Prior Publication Data

US 2010/0242892 A1 Sep. 30, 2010

(30) Foreign Application Priority Data

Mar. 31, 2009 (JP) ..... 2009-087923

(51) Int. Cl.
*F02M 35/10* (2006.01)

(52) U.S. Cl.
USPC ..... 123/184.42; 123/184.47

(58) Field of Classification Search ..... 123/184.24–184.26, 184.34–184.36, 123/184.42–184.44, 184.47–184.49
See application file for complete search history.

(56) References Cited

U.S. PATENT DOCUMENTS

| | | | | |
|---|---|---|---|---|
| 3,520,284 | A * | 7/1970 | Jantschke et al. | 123/184.34 |
| 7,637,242 | B2 | 12/2009 | Koide et al. | |
| 2010/0000489 | A1 | 1/2010 | Otaki et al. | |
| 2010/0012070 | A1 | 1/2010 | Otaki | |

FOREIGN PATENT DOCUMENTS

| | | |
|---|---|---|
| JP | 6-235357 | 8/1994 |
| JP | 9-177624 | 7/1997 |
| JP | 10-318056 | 12/1998 |
| JP | 2005-016348 | 1/2005 |
| JP | 2005-273454 | 10/2005 |
| JP | 2008-184939 | 8/2008 |

OTHER PUBLICATIONS

Japan Office action, mail date is Jul. 31, 2012.
Japan Office action, mail date is Feb. 26, 2013.

* cited by examiner

*Primary Examiner* — Noah Kamen
(74) *Attorney, Agent, or Firm* — Greenblum & Bernstein P.L.C.

(57) ABSTRACT

The present invention provides an intake manifold that improves the intake performance and has a reduced weight. The intake manifold includes a surge tank and intake pipes. Each intake pipe has an inlet port that is connected to the surge tank. The inlet ports are arranged along a flow direction of air drawn into the surge tank from the opening of the surge tank, and project into the surge tank along direction that intersects the flow direction. Each adjacent pair of the inlet ports are separated only by a single common pipe wall.

8 Claims, 6 Drawing Sheets

INTAKE MANIFOLD

BACKGROUND OF THE INVENTION

The present invention relates to an intake manifold in the intake system of an automobile engine.

Known types of such intake manifolds include the ones disclosed, for example, in Japanese Laid-Open Patent Publication Nos. 9-177624 and 2008-184939.

The intake manifold disclosed in Japanese Laid-Open Patent Publication No. 9-177624 includes a surge tank and a plurality of intake pipes each having an inlet port. The inlet ports of the intake pipes are connected to and protrude into the surge tank. The inlet ports extend in a direction of air flow from the opening of the surge tank, and are arranged along a direction perpendicular to the air flow direction.

The intake manifold disclosed in Japanese Laid-Open Patent Publication No. 2008-184939 also includes a surge tank and a plurality of intake pipes each having an inlet port. The inlet ports of the intake pipes are connected to and protrude into the surge tank. These inlet ports are provided symmetrically on both sides of the opening of the surge tank, and are arranged along the flow direction of air from the surge tank opening.

These types of conventional intake manifold have the following drawbacks.

In the conventional structures disclosed in the above two documents, the inlet ports are arranged inside the surge tank. Thus, when air is drawn into the inlet ports, a great turbulence is likely to be generated about each inlet port. Such turbulence disturbs smooth intake of air, possibly deteriorates the intake performance, and, as a result, lowers the combustion efficiency of the engine.

Particularly, in the configuration disclosed in Japanese Laid-Open Patent Publication No. 2008-184939, a pair of the inlet ports are arranged on either side of the surge tank along the direction of air flow, and open in a direction perpendicular to the flow direction of air. This is likely to generate a great turbulence between adjacent inlet ports, and particularly lowers the intake performance of the inlet ports on the downstream side. As a result, the amount of air drawn into the inlet ports becomes uneven. This not only lowers the combustion efficiency, but also generates irregular vibration as the engine operates.

SUMMARY OF THE INVENTION

The present invention was made for solving the above problems in the prior art. Accordingly, it is an objective of the present invention to provide an intake manifold that improves the intake performance and has a reduced weight.

To achieve the foregoing objective and in accordance with one aspect of the present invention, an intake manifold including a surge tank and a plurality of intake pipes each having an inlet port is provided. The inlet ports are connected to the surge tank. The intake manifold draws air into the surge tank from an opening of the surge tank and supplies the air to an engine through the intake pipes. The inlet ports are arranged along a flow direction of air drawn into the surge tank from the opening of the surge tank, and project into the surge tank along a direction that intersects the flow direction at the surge tank opening. Each adjacent pair of the inlet ports are separated only by a single common pipe wall.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Hereinafter, an intake manifold 11 according to one embodiment of the present invention will now be described with reference to FIGS. 1 to 6. The intake manifold 11 is mounted in a horizontally-opposed four-cylinder engine. In this description, the left-right direction in FIG. 1 is defined as left-right direction of the intake manifold 11, and a direction perpendicular to the sheet of FIG. 1 is defined as the front-rear direction of the intake manifold 11.

Figure 1:
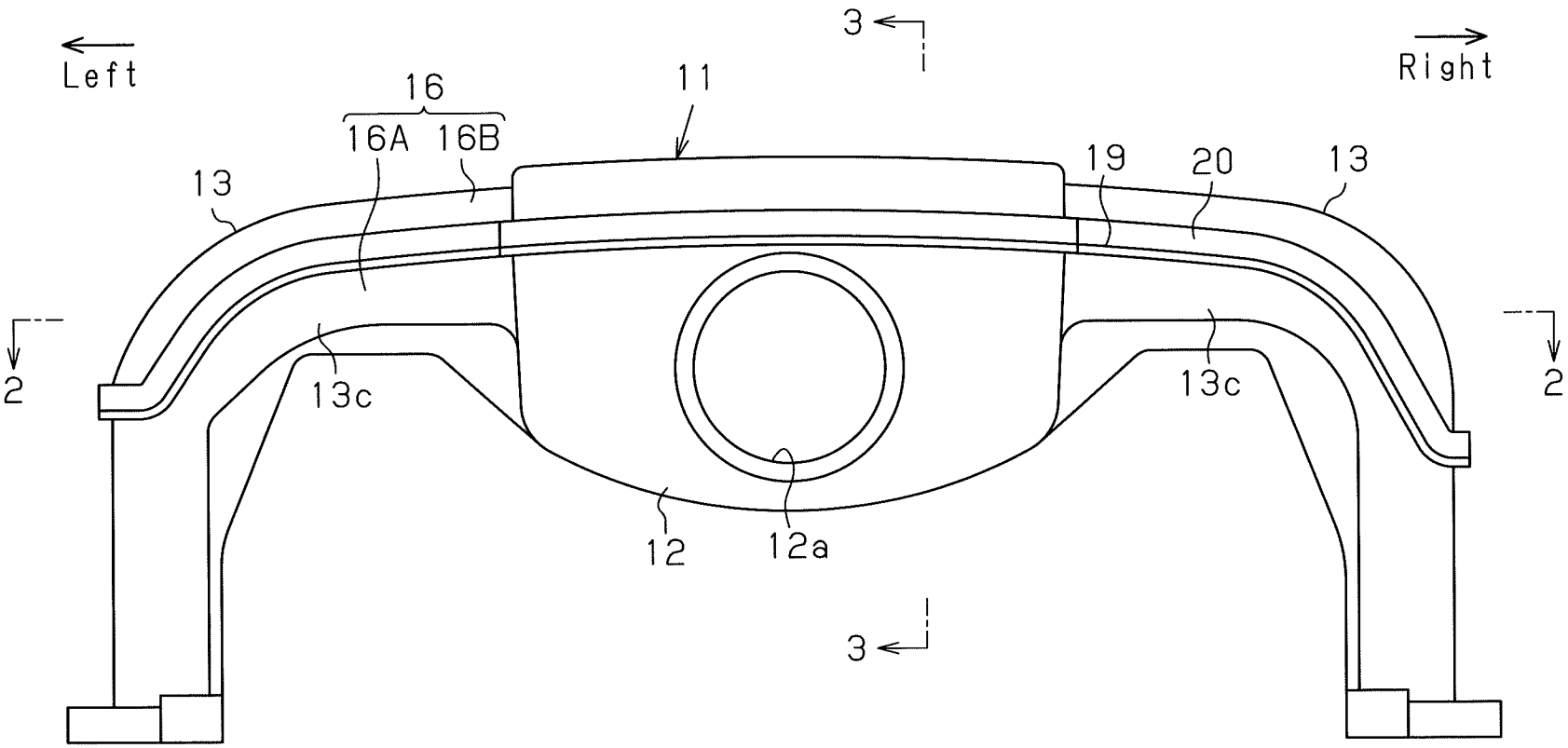
FIG. 1 is a front view illustrating an intake manifold according to one embodiment of the present invention.
Figure 2:
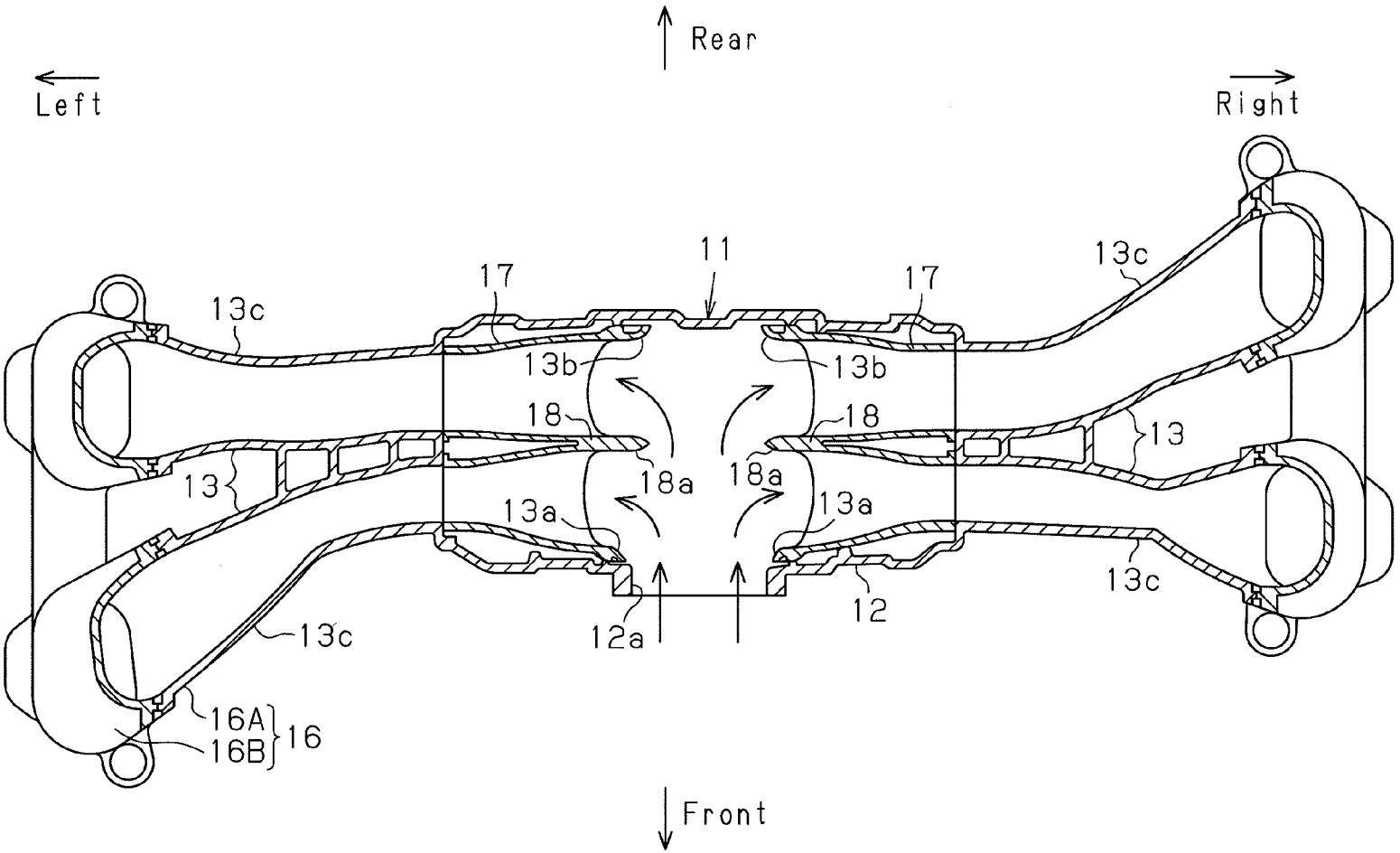
FIG. 2 is a cross-sectional view taken along line 2-2 of FIG. 1.
Figure 3:
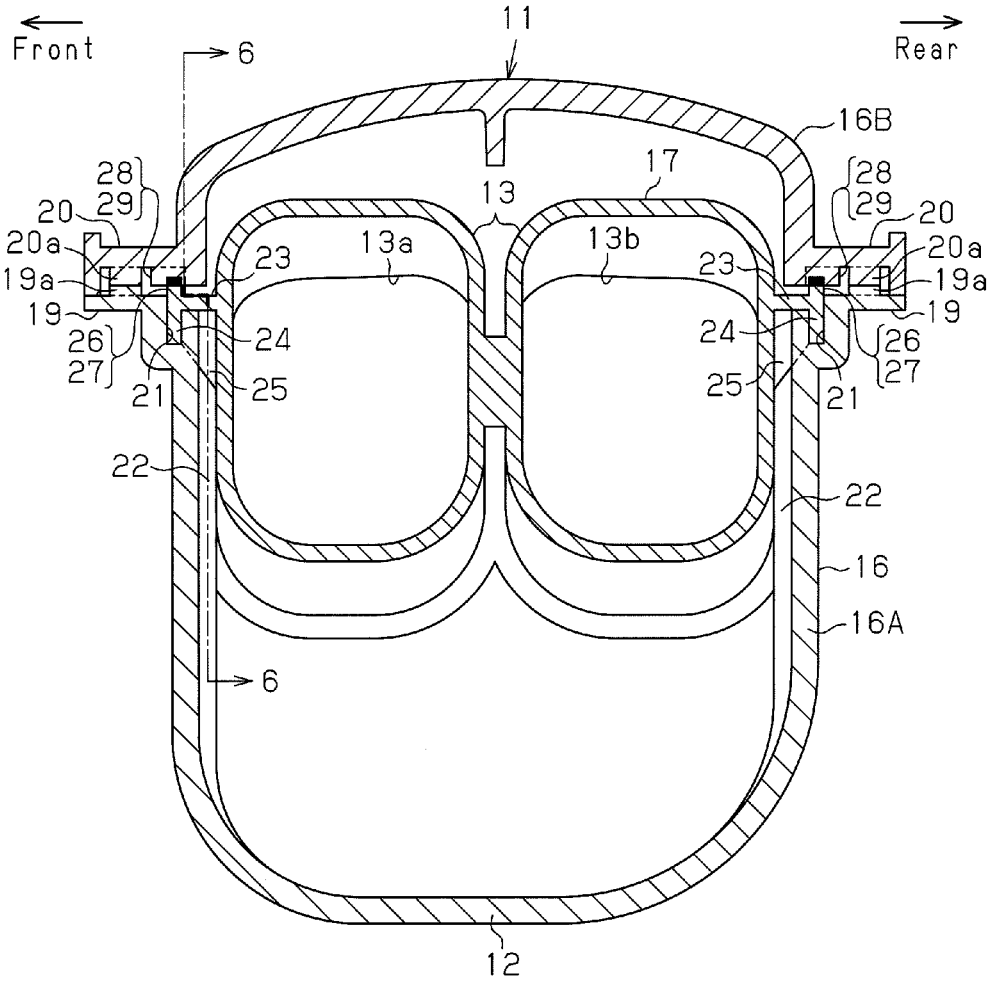
FIG. 3 is a cross-sectional view taken along line 3-3 of FIG. 1.

With reference to FIGS. 1 to 3, the intake manifold 11 of the present embodiment is made of a heat resistant synthetic resin (for example, polyamide resin), and includes a surge tank 12 and pairs of intake pipes 13 provided on the left and right sides of the surge tank 12. The intake pipes 13 each correspond to one of the combustion chambers provided on both sides of the horizontal-opposed engine. Each pair of intake pipes 13 is formed by main bodies 13*c* and an inlet pipe member 17, which is formed separately from the main bodies 13*c*. The inlet pipe members 17 are incorporated in the surge tank 12.

The surge tank 12 and the main bodies 13*c* of the intake pipes 13 form a framework 16 of the intake manifold 11. The surge tank 12 is located at the center of the framework 16. The framework 16 includes a first segment 16A located in a lower portion and a second segment 16B, which is fixed to the top of the first segment 16A.

The surge tank 12 has on its front (lower surface as viewed in FIG. 2) an opening 12*a* for drawing in air. The opening 12*a* is connected to an air duct (not shown), which supplies air that has been filtered by an air cleaner (not shown) to the surge tank 12. Of the two intake pipes 13 in each pair, the one that is located on the upstream side in the flow direction of air introduced into the surge tank 12 through the opening 12*a* has an inlet port 13*a* connected to the surge tank 12, while the one on the downstream side has an inlet port 13*b* connected to the surge tank 12. The inlet ports 13*a*, 13*b* are formed in the corresponding inlet pipe member 17, and arranged to be left-right symmetrical along the flow direction of air drawn into the surge tank 12 through the opening 12*a*. The inlet ports 13*a*, 13*b* open in directions intersecting the flow direction of air and protrude into the surge tank 12.

Figure 4:
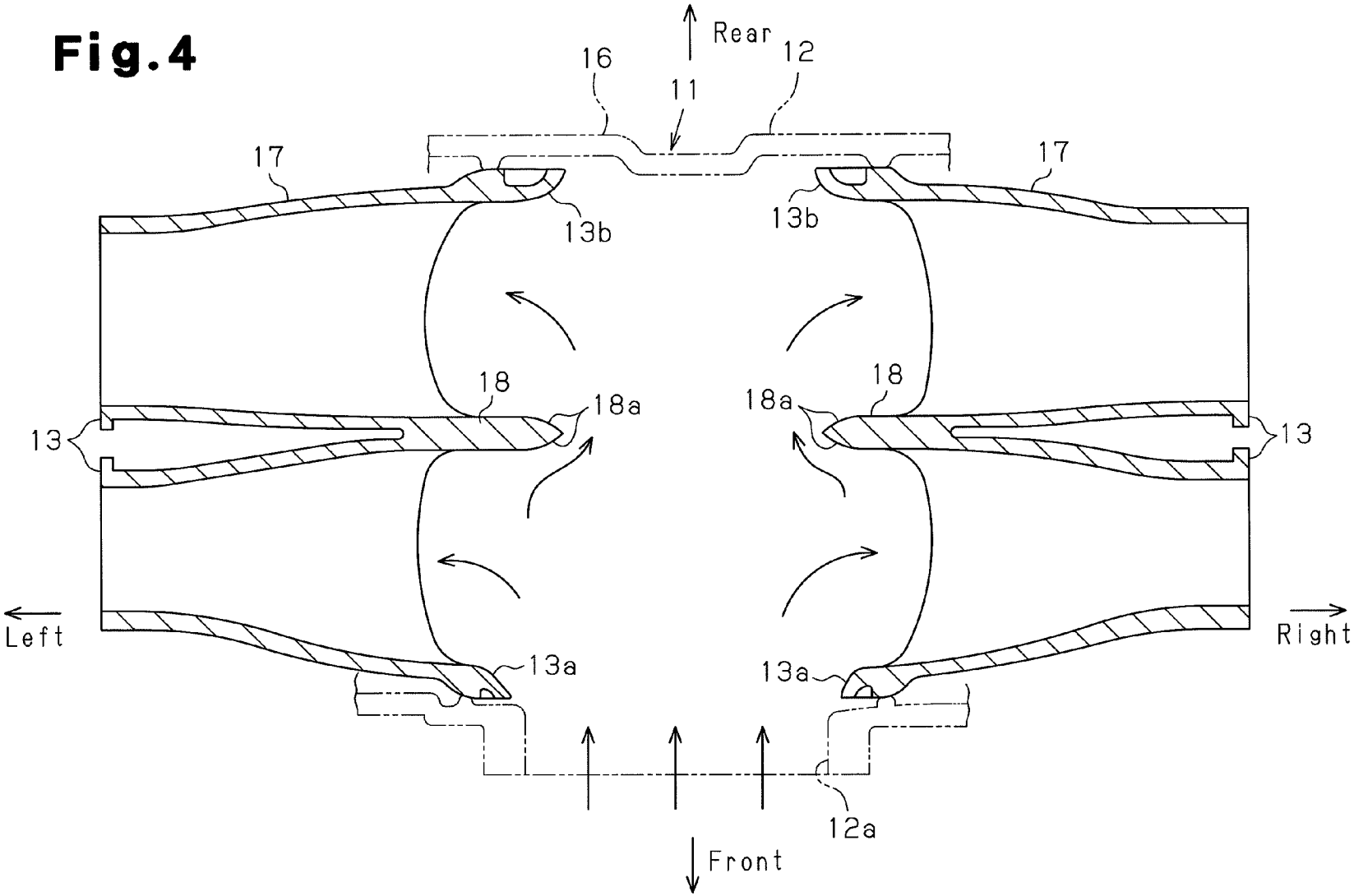
FIG. 4 is an enlarged cross-sectional view illustrating part of FIG. 2.

As shown in FIGS. 2 and 4, the inlet ports 13*a*, 13*b* of the each inlet pipe member 17 are adjacent to each other along the flow direction of air, that is, along the front-rear direction, and are separated only by a common pipe wall 18. That is, the inlet ports 13*a*, 13*b* are arranged on the upstream side and the downstream side of the air flow direction, respectively, while being separated by the distance corresponding to the thickness of the common pipe wall 18. The distal portion of the common pipe wall 18 protrudes into the surge tank 12. The front and rear sides of the distal portion of the common pipe wall 18, that is, the surface on the upstream side and the surface on the downstream side in the air flow direction, each have a convex surface 18*a* that converges in the protruding direction at the distal portion. Of each pair of the inlet ports 13*a*, 13*b*, which are adjacent to each other in the air flow direction, the inlet port 13*b* on the downstream side in the air flow direction protrudes further into the surge tank along a direction that intersects the flow direction of air at the opening 12*a*, that is, further toward the center of the surge tank 12, than the inlet port 13*a* on the upstream side.

In the framework 16, the first segment 16A has an open upper end, and the second segment 16B has an open lower end. A flange 19 projecting outward is formed on the outer periphery of the opening of the first segment 16A. A protrusion 19*a*, which functions as a weld zone, is formed on the flange 19. A flange 20 projecting outward is formed on the outer periphery of the opening of the second segment 16B. The flange 20 corresponds to the flange 19 of the first segment 16A. A protrusion 20*a*, which serves as a weld zone, is formed on the lower surface of each flange 20. The protrusion 20*a* is contactable with the protrusion 19*a* on the first segment 16A.

Figure 6:
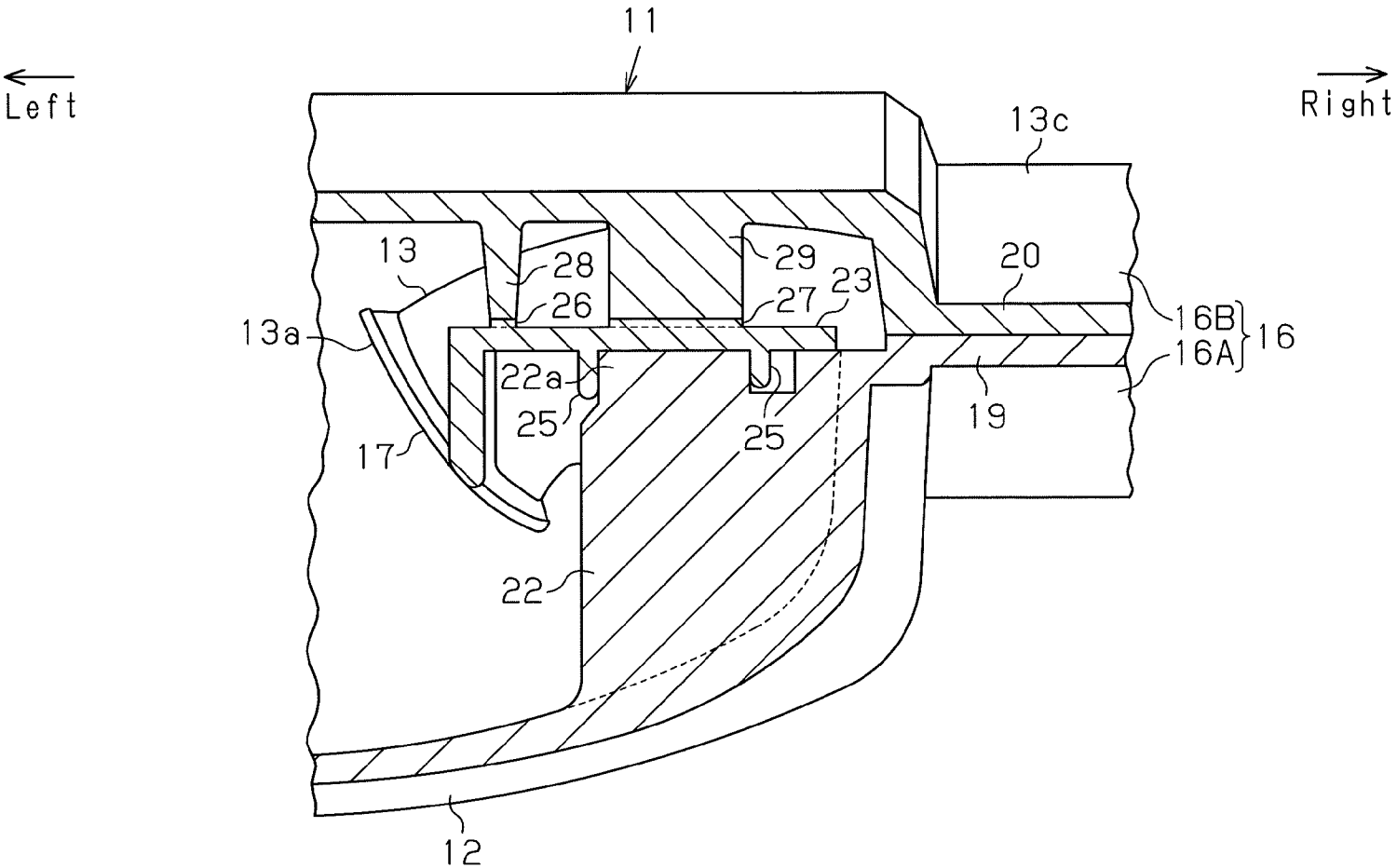
FIG. 6 is a partial cross-sectional view taken along line 6-6 of FIG. 3.

As shown in FIGS. 3 and 6, a pair of left and right engagement grooves 21 are formed on the front and rear side walls of the first segment 16A, near the left and right ends of the surge tank 12. These engagement grooves 21 are formed in the inner sides of the flange 19 to extend along the left-right direction. In the vicinity of each engagement groove 21, a positioning projection 22 is formed on the inner wall of the first segment 16A. In an upper end portion of each positioning projection 22, a positioning portion 22*a* having a predetermined width in the left-right direction is formed.

In front of and behind each inlet pipe member 17, left and right support plates 23 are provided, which are integrally formed with the inlet pipe member 17. Each support plate 23 has an engagement projection 24, which is engageable with the engagement groove 21 formed on the flange 19 of the first segment 16A. A pair of positioning pieces 25 are formed on the lower surface of each support plate 23. The positioning pieces 25 are separated along the left-right direction from each other by a predetermined distance, and engageable with the left and right side surfaces of the corresponding positioning portion 22*a*.

When a pair of inlet pipe members 17 are incorporated in the first segment 16A, the engagement of the upper surfaces of the positioning projections 22 and the lower surfaces of the support plates 23 determines the positions of the inlet pipe member 17 in the up-down direction. Also, the engagement of the engagement grooves 21 and the engagement projections 24 determines the positions of the inlet pipe members 17 in the front-rear direction. At the same time, the engagement of the positioning portions 22*a* and the positioning pieces 25 determines the positions of the inlet pipe members 17 in the left-right direction.

Figure 5:
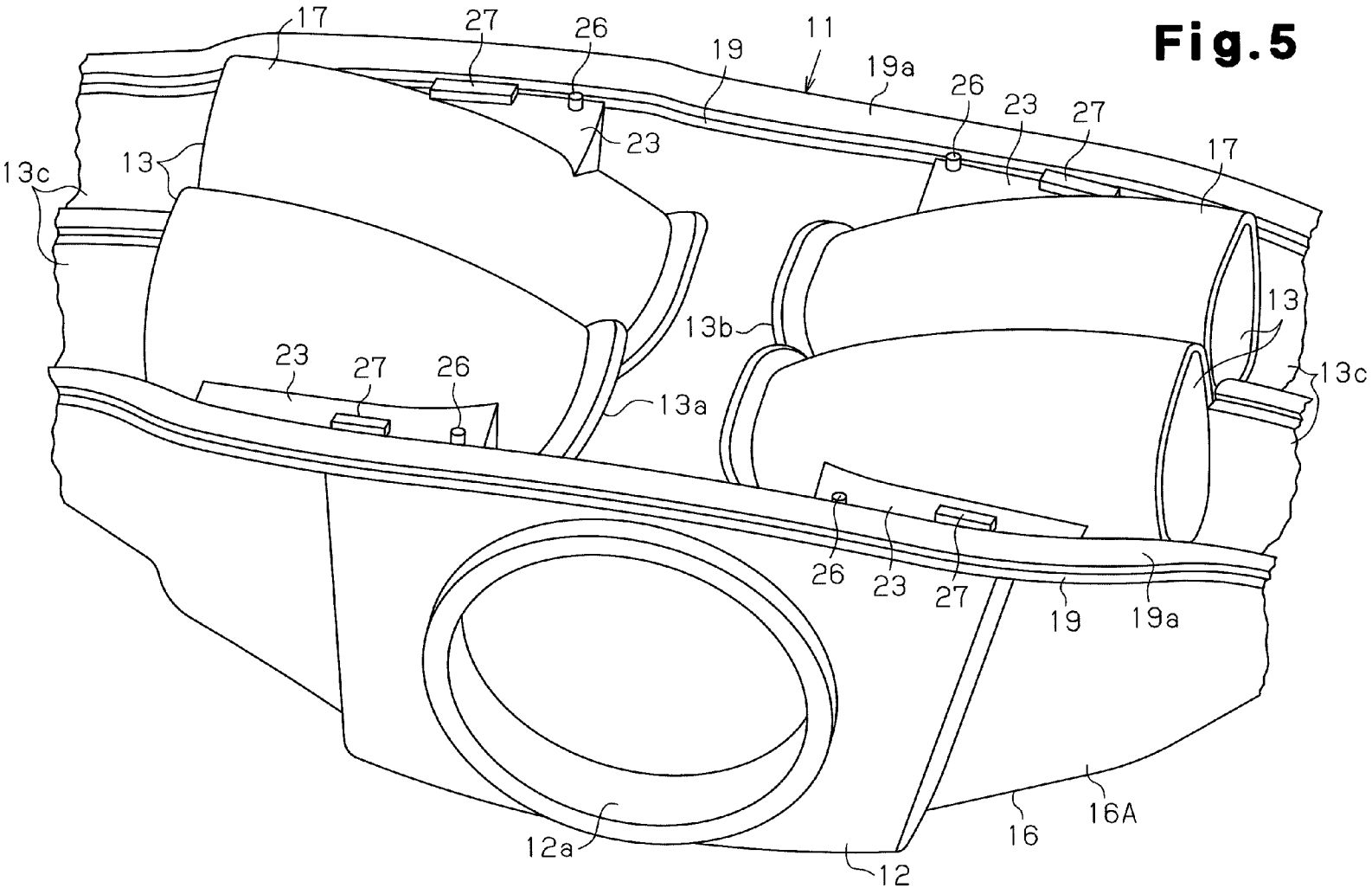
FIG. 5 is a partial perspective view illustrating the intake manifold from which the second segment of the framework has been removed.

As shown in FIGS. 3, 5, and 6, a cylindrical weld projection 26 and a rectangular parallelepiped weld projection 27 are formed on the upper surface of each support plate 23 of each inlet pipe member 17. Two projections 28, 29 functioning as weld zones are formed on front and rear lower portions of the second segment 16B. The projections 28, 29 are contactable with the projections 26, 27.

When the second segment 16B is assembled to the first segment 16A with the pair of inlet pipe members 17 installed in the first segment 16A, the protrusions 19*a*, 20*a*, which are weld zones of the segments 16A, 16B, contact each other. At the same time, the weld projections 28, 29 of the second segment 16B contact the weld projections 26, 27 of the inlet pipe members 17. In this state, vibration is applied to the second segment 16B, so that friction is generated between the weld protrusions 19*a*, 20*a* and between the weld projections 28, 29 and the weld projections 26, 27. Accordingly, the weld protrusions 19*a* and 20*a*, and the weld projections 28, 29 and 26, 27 are melted and fixed to each other. The vibration welding integrates the segments 16A and 16B of the framework 16 with each other, and integrates the inlet pipe members 17 and the framework 16 with each other.

The operation of the intake manifold 11 configured as described above will now be described.

In a state where the intake manifold 11 is mounted on an engine, an air duct is connected to the opening 12*a* of the surge tank 12, and the distal end of each intake pipe 13 is connected to an intake port of the engine. If the engine is started in this state, air is drawn into the surge tank 12 through the opening 12*a*, and introduced into the intake pipes 13 through the inlet ports 13*a*, 13*b*. The air is then supplied to the combustion chambers of the engine.

In the present embodiment, the inlet ports 13*a*, 13*b* are arranged along the flowing direction of air drawn into the surge tank 12 through the opening 12*a*, and the front and rear inlet ports 13*a*, 13*b* are arranged adjacent to each other with the common pipe wall 18 disposed therebetween. In other words, the front and rear adjacent inlet ports 13*a*, 13*b* are separated from each other only by the thickness of the common pipe wall 18. Thus, flow velocity difference or turbulence hardly occurs between the inlet ports 13*a* and 13*b*. Furthermore, the convex surfaces 18*a*, which converge toward the distal end, are formed on both surfaces of the distal portion of the common pipe wall 18 between the adjacent inlet ports 13*a* and 13*b*. This structure inhibits the occurrence of swirl of air and allows air to smoothly flows to the downstream side along the convex surfaces 18*a*. This equalizes air drawn into the front and rear inlet ports 13*a*, 13*b*, and prevents the intake performance of the inlet ports 13*a*, 13*b* from being deteriorated. Therefore, the engine is allowed to operate at a high combustion efficiency, and irregular vibration of the engine is inhibited.

The present embodiment has the following advantages.

(1) Since the adjacent inlet ports 13*a*, 13*b* are arranged to be close to each other with the single common pipe wall 18 in between, flow velocity difference and turbulence of air hardly occur between the inlet ports 13*a*, 13*b*. Therefore, equalized amount of air is smoothly drawn into both of the inlet ports 13*a*, 13*b*, so that the intake performance of the intake manifold 11 is improved.

(2) The convex surfaces 18*a*, which converge toward the distal end, are formed on both surfaces of the distal portion of the common pipe wall 18 between the adjacent inlet ports 13*a* and 13*b*. This prevents the common pipe wall 18 from causing turbulence, and smoothly supplies air to the inlet port 13*b* on the downstream side. Therefore, not only the intake performance of the intake manifold 11 is improved, but also air is equally supplied to the front and rear inlet ports 13*a*, 13*b*.

(3) The inlet port 13*b* located on the downstream side in the air flow direction projects further toward the air introducing side than the inlet port 13*a* on the upstream side. This improves the air introducing performance of the inlet port 13*b* on the downstream side of the air flow direction, thereby further equalizing the amount of air drawn into the inlet ports 13*a*, 13*b*.

(4) Each pair of intake pipes 4 is formed by main bodies 13*c* and an inlet pipe member 17, which is formed separately from the main bodies 13*c*. Therefore, if the inlet pipe members 17 are configured to protrude into the surge tank 12 in order to reduce the overall size, it is easy to form the framework 16 constituted by the main bodies 13*c* of the intake pipes 13 and the surge tank 12.

(5) The framework 16 includes the first segment 16A and the second segment 16B. With the inlet pipe members 17 incorporated in the framework 16, the first segment 16A and the second segment 16B are fixed to each other by vibration welding. Also, the framework 16 and the inlet pipe members 17 are fixed to each other by vibration welding. Therefore, the assembly of the inlet pipe members 17 to the framework 16 is simplified.

(6) When assembling the intake manifold 11, the inlet pipe members 17 are positioned in relation to the first segment 16A, and welded to the second segment 16B. This simplifies the structure of the intake manifold 11 and facilitates the assembly.

(7) The components of the intake manifold 11 only include the framework 16 including the first and second segments 16A, 16B and the inlet pipe members 17. Accordingly, the number of components of the intake manifold 11 is reduced, and the assembly is simplified. Furthermore, since the entire intake manifold 11 is formed of a synthetic resin, weight reduction is achieved.

(Modifications)

The above described embodiment may be modified as described below.

The framework 16 may be formed by three or more segments.

For example, the present invention may be applied to intake manifolds formed by a material other than synthetic resin, such as an aluminum alloy.

The main bodies 13*c* of the intake pipes 13 and the inlet pipe members 17 may be formed integrally.

The inlet port 13*b*, which is located on the downstream side of the flow direction of air introduced through the opening 12*a* of the surge tank 12, may protrude by the same amount as the inlet port 13*a* on the upstream side. Also, the inlet port 13*a* on the upstream side may protrude further into the surge tank 12 along a direction that intersects the flow direction of air at the surge tank opening 12*a* than the inlet port 13*b* on the downstream side.

The shape of the sides of the distal portion of the common pipe wall 18 is not particularly limited, but may be formed into shapes other than that shown in above. For example, the sides may be flat.

The present invention may be applied to the intake manifold of an inline engine. In this case, the inlet ports 13*a* of intake pipes 13 are arranged only on one side of the surge tank 12. It is preferable that the closer to the downstream end, the more projected into the flow passage of the air the inlet port becomes.

In the above embodiment, the number of the intake pipes 13 may be changed. For example, in the case where the present invention is applied to a horizontally-opposed four-cylinder engine, three intake pipes 13 each having an inlet port are provided on either side, and a total of six intake pipes 13 are provided.

Therefore, the present examples and embodiments are to be considered as illustrative and not restrictive and the invention is not to be limited to the details given herein, but may be modified within the scope and equivalence of the appended claims.

The invention claimed is:

1. An intake manifold comprising a surge tank and a plurality of intake pipes each having an inlet port, the inlet ports being connected to the surge tank, the intake manifold drawing air into the surge tank from an opening of the surge tank and supplies the air to an engine through the intake pipes, wherein the inlet ports are arranged along a flow direction of air drawn into the surge tank from the opening of the surge tank, and project into the surge tank along a direction that intersects the flow direction at the surge tank opening, wherein each adjacent pair of the inlet ports are separated only by a single common pipe wall, and wherein a distal portion of the common pipe wall projects into the surge tank, convex surfaces being formed on the sides of the distal portion, and the convex surfaces converging along the projecting direction of the distal portion.

2. The intake manifold according to claim 1, wherein an inlet port that is located on a downstream side in the flow direction projects further along the direction that intersects the flow direction at the surge tank opening than an inlet port that is located on an upstream side in the flow direction.

3. The intake manifold according to claim 1, wherein the inlet ports of the intake pipes are arranged symmetrically on both sides of the surge tank opening.

4. The intake manifold according to claim 1, wherein each intake pipe includes a main body and an inlet pipe member that is formed separately from the main body, the inlet port being formed in the inlet pipe member.

5. The intake manifold according to claim 4, wherein the inlet pipe members are incorporated in a frame work that includes the main bodies of the intake pipes and the surge tank.

6. The intake manifold according to claim 5, wherein the entire intake manifold is formed of synthetic resin.

7. The intake manifold according to claim 6, wherein the framework includes a plurality of segments, and wherein, with the inlet pipe members incorporated in the framework, the segments are fixed to each other by welding and the framework and the inlet pipe members are fixed to each other by welding.

8. The intake manifold according to claim 7, wherein the framework includes a first segment and a second segment, and wherein the inlet pipe members are welded to the second segment after the positions of the inlet pipe members are determined with respect to the first segment.

* * * * *